US005727631A

United States Patent [19]

Baker et al.

[11] Patent Number: 5,727,631

[45] Date of Patent: Mar. 17, 1998

[54] COILED TUBING HANGER

[75] Inventors: Dwight Baker; James C. Baker, both of Rush Springs, Okla.

[73] Assignee: Total Tool, Inc., Rush Springs, Okla.

[21] Appl. No.: 614,433

[22] Filed: Mar. 12, 1996

[51] Int. Cl.[6] ..... E21B 19/10; E21B 33/04

[52] U.S. Cl. ..... 166/379; 166/88.3

[58] Field of Search ..... 166/379, 382, 166/88.3, 88.4, 88.2, 212

[56] References Cited

U.S. PATENT DOCUMENTS

| | | | |
|---|---|---|---|
| 2,312,487 | 3/1943 | Roach et al. | 166/88.3 X |
| 4,541,490 | 9/1985 | Bigbie et al. | 166/88.2 X |
| 4,554,971 | 11/1985 | Cobb | 166/88 |
| 5,092,400 | 3/1992 | Jagert | 166/88.2 |
| 5,515,925 | 5/1996 | Boychuk | 166/88.3 X |

OTHER PUBLICATIONS

PEDCOR product brochure "Pedcor Safeset Coil Tubing Hanger," not dated.

Wellhead Control Products, Inc. booklet "Coiled Tubing Hanger Systems for Live Well Installations," not dated.

Specialty Wellhead & Tool Company booklet "Coiled Tubing Products," not dated.

*Primary Examiner*—William P. Neuder

*Attorney, Agent, or Firm*—Dunlap & Codding, P.C.

[57] ABSTRACT

A coiled tubing hanger including a hanger bowl, a slip bowl supported in the hanger body, a plurality of slip segments disposed in the slip bowl so as to be movable between a retracted position wherein the tubular member is able to pass through the coiled tubing hanger and an extended position wherein a serrated surface of the slip segments engages the coiled tubing and forces the slip segments along the slip bowl so as to wedge the slip segments between the slip bowl and the coiled tubing to hold the coiled tubing. The slip segments are biased in the retracted position with a pair of slip retaining rings and the slip segments are moved between the retracted portion and the extended position with a plurality of spring-loaded pins disposed through the hanger body and engagable against the outer side of the slip segments such that the slip segments are disposed in the extended position when the pins are urged inwardly and such that the slip segments are biased in the retracted position when the pins are urged outwardly.

31 Claims, 11 Drawing Sheets

COILED TUBING HANGER

BACKGROUND OF THE INVENTION

1. Field of the Invention

The present invention relates generally to tubing hangers, and more particularly, but not by way of limitation, to an improved coiled tubing hanger which effectively suspends the coiled tubing without subjecting the coiled tubing to undue stress and which provides total pressure control thereby eliminating the requirement of using a mechanical or hydraulic access window.

2. Description of Related Art

The operational concept of a coiled tubing system involves running a continuous string of small diameter tubing into a well bore to perform specific well servicing operations without disturbing existing completion tubulars and equipment. Coiled tubing is also used with increased frequency in conventional or traditional oil well production operations.

When installing and hanging coiled tubing with prior art internal coiled tubing hangers, the well is ordinarily killed to control the pressure of the well. With the well killed, a blowout preventer (BOP) and an access window is installed on the wellhead. A coiled tubing injection unit is in turn installed above the access window and the coiled tubing is run to a desired depth.

To hang the coiled tubing, the lower set of BOP rams are closed and the access window is opened. A wraparound style hanger and slips are then disposed about the coiled tubing via the access window and lowered through the blow out preventer then the hanger and slips are lowered into the tubinghead. The coiled tubing is then landed with the weight of the tubing supported by the hanger. The coiled tubing is finally cut and the coiled tubing unit, the access window, and the BOP removed and replaced with additional wellhead equipment.

Although this procedure is widely utilized in the industry to hang coiled tubing, several problems are encountered. First, the need to kill the well increases the length of time the well is out of service and the risk of damage being incurred to the formation. Next, the use of access windows have been proven to be unreliable in controlling pressure and therefore their use poses a safety concern for workmen.

Another problem encountered in coiled tubing suspension is that because coiled tubing has less tensile strength than conventional tubing, the hanger slips can cause point loading on the coiled tubing which in turn causes the coiled tubing to fail or collapse and drop down to the bottom of the well. Point loading results from the weight of the coiled tubing not being evenly distributed across the slips. Instead, the weight of the coiled tubing is set on a relatively small portion of the slips thereby causing the weight of the coiled tubing to be concentrated at a small area.

To this end, a need exists for a self-contained automatic mechanical hanger for supporting a string of coiled tubing extended into a well bore without causing damage to the coiled tubing and without requiring the use of a mechanical or hydraulic access window to hang the coiled tubing while maintaining pressure control. It is to such an improved coiled tubing hanger that the present invention is directed.

BRIEF DESCRIPTION OF THE DRAWINGS

FIG. 6 is an elevational view, partially in cross section, showing the internal coiled tubing hanger of FIG. 1 disposed in the wellhead configuration.

FIG. 9 is an elevational view, partially in cross section, showing the internal coiled tubing hanger of the present invention installed in the tubinghead and with a christmas tree connected thereto.

DETAILED DESCRIPTION

Figure 1:
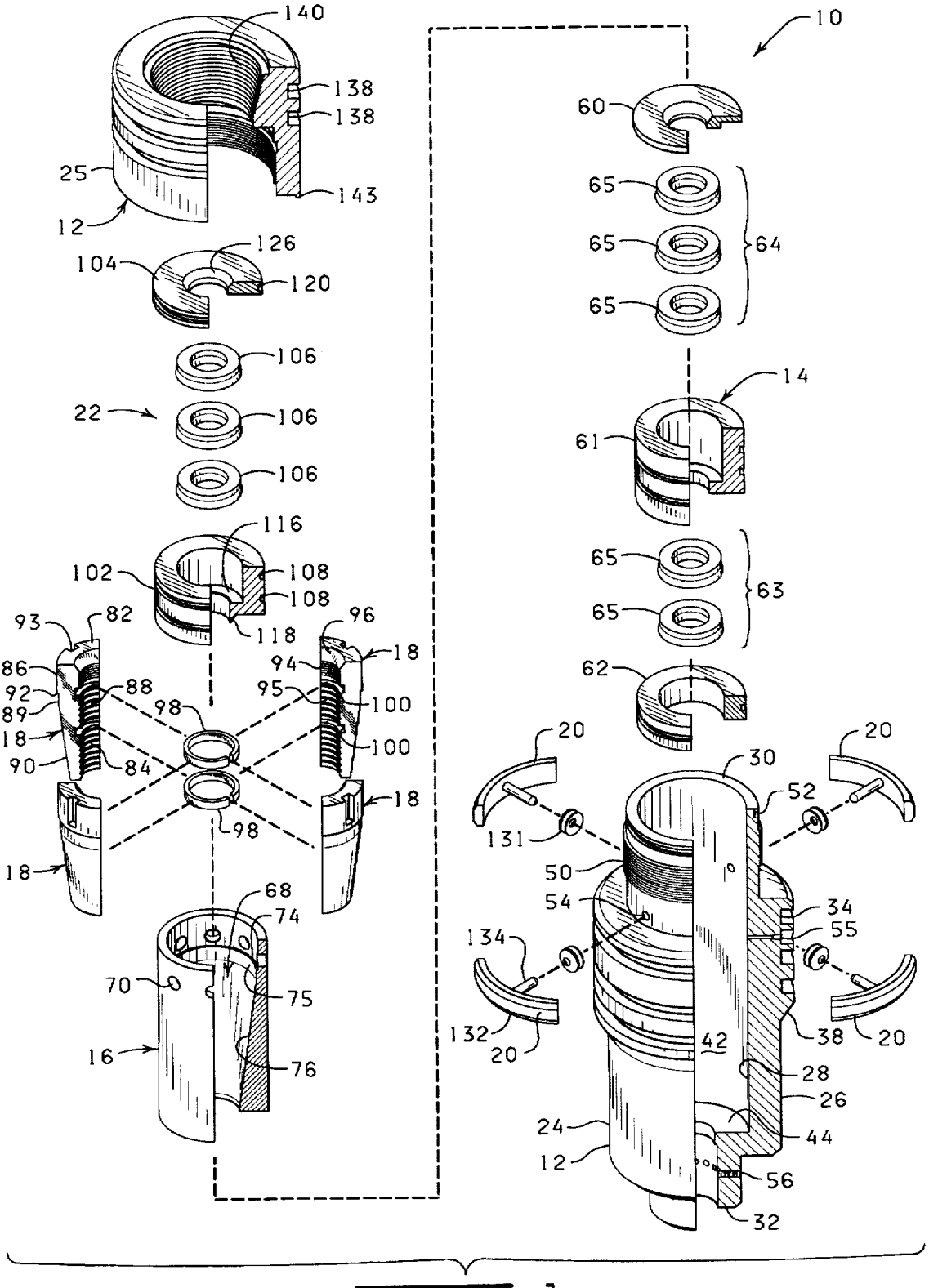
FIG. 1 is a partially cutaway, exploded view of an internal coiled tubing hanger constructed in accordance with the present invention.
Figure 2:
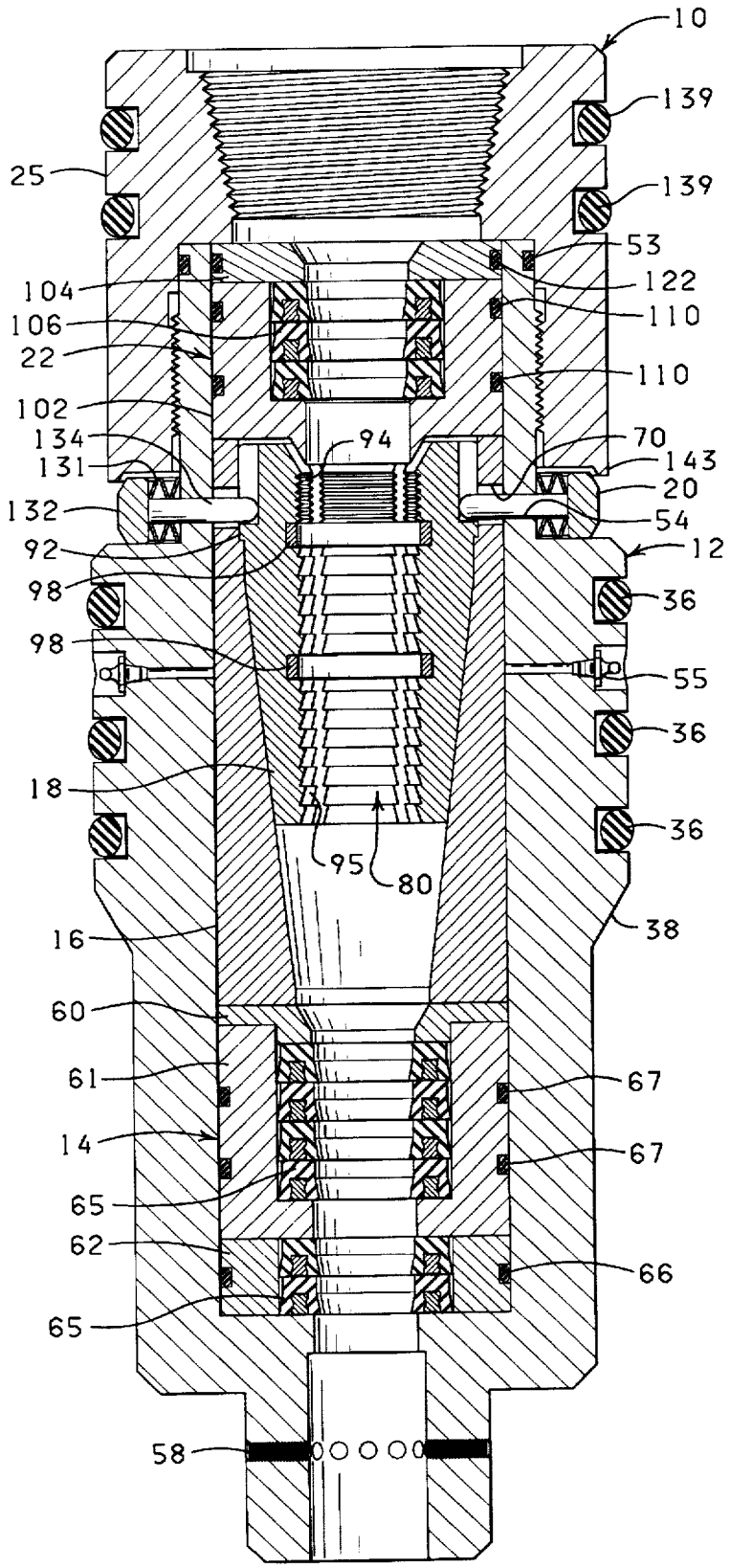
FIG. 2 is an elevational view, partially in cross section, showing the internal coiled tubing hanger of FIG. 1 assembled.

Referring now to the drawings, and more particularly to FIGS. 1 and 2, an internal coiled tubing hanger 10 constructed in accordance with the present invention is illustrated. The coiled tubing hanger 10 includes a hanger body 12, a lower seal assembly 14, a slip bowl 16, a plurality of slip segments 18, a plurality of slip segment setting pins 20, and an upper seal assembly 22.

The hanger body 12 is dimensioned to be disposed in a component of a wellhead assembly adapted to receive the hanger body, such as a tubinghead 33 (FIG. 3) or a casinghead. The hanger body 12 includes a lower body portion 24 and an upper body portion 25. The lower body portion 24 has an external surface 26, an internal surface 28, an upper end 30, and a lower end 32. The external surface 26 has a plurality of annular grooves 34 (FIG. 1) each of which are dimensioned to receive an O-ring 36 (FIG. 2) for providing a fluid-tight seal between the external surface 26 and the tubinghead 33. The external surface 26 is provided with a shoulder 38 for supporting the hanger body 12 on a corresponding shoulder in the tubinghead 33 which forms a tubinghead bowl 40.

The internal surface 28 of the hanger body 12 defines a bore 42 extending between the upper end 30 and the lower end 32. As best shown in FIG. 1, the internal surface 28 has a support shoulder 44 formed near the lower end 32 thereof.

The upper end 30 of the lower body portion 24 has an external threaded portion 50 for connection with the upper body portion 25 and an annular groove 52 for receiving an O-ring 53 (FIG. 2). The lower body portion 24 is provided with a plurality of pin receiving holes 54 spaced circumferentially about the lower body portion 24 and extending radially therethrough. A grease port 55 is provided through the lower body portion 24 of the hanger body 12 so that the coiled tubing hanger 10 can be lubricated when necessary to prevent hydrate formation in the coiled tubing hanger 10.

The lower end 32 of the lower body portion 24 of the hanger body 12 is provided with a plurality of screw receiving holes 56 spaced circumferentially about the lower end 32 of the lower body portion 24 and extending radially therethrough. Each screw receiving hole 56 is adapted to receive a shear screw 58 (FIG. 2). The shear screws 58 are used to attach the coiled tubing hanger 10 to the coiled tubing during installation as will be described in greater detail below.

The lower seal assembly 14 is disposed in the hanger body 12 and supported by the support shoulder 44 of the lower body portion 24. The lower seal assembly 14 includes an upper spacer ring 60, an intermediate spacer ring 61, a lower spacer ring 62, a primary seal assembly 63 and a secondary seal assembly 64. The primary seal assembly 63 is shown to be a pair of resilient, pressure activated seal members 65 and the secondary seal assembly 64 is shown to be four of the same such seal members 65. The seal members 65 are preferably conventional pressure activated, poly pack seals well known in the industry.

The lower spacer ring 62 and the primary seal assembly 63 are disposed on the support shoulder 44. The lower spacer ring 62 is dimensioned to act as a compression limit for the primary seal assembly 63 and is provided with an O-ring 66 (FIG. 2) in the outer peripheral surface thereof to provide a substantially fluid-tight seal between the lower spacer ring 62 and the hanger body 12.

The intermediate spacer ring 61 has a substantially L-shaped cross section and is positioned on the lower spacer ring 62. The intermediate spacer ring 61 is provided with a pair of O-rings 67 (FIG. 2) in the outer peripheral surface thereof to provide a substantially fluid-tight seal between the intermediate spacer ring 61 and the hanger body 12. The secondary seal assembly 64 is disposed on the lower leg of the intermediate spacer ring 61. The lower leg of the intermediate spacer ring 61 functions to isolate the primary seal assembly 63 from the secondary seal assembly 64 so that the secondary seal assembly 64 is not loaded or activated when the primary seal assembly 63 is acted on by pressure while the coiled tubing is being run into the well bore. Thus, the secondary seal assembly 64 remains relaxed during installation of the coiled tubing and unexposed to the harsh installation environment so that the secondary seal assembly 64 is available for pressure control if the primary seal assembly 63 fails.

The upper spacer ring 60 is configured to be supported on the upper end of the intermediate spacer ring 61 and to cooperate with the lower leg of the intermediate spacer ring 61 to carry the secondary seal assembly 64.

The slip bowl 16 is a cylindrically shaped member having a bore 68 extending from the upper end to the lower end thereof. The slip bowl 16 is provided with a plurality of pin receiving holes 70 disposed about the hanger body 12 near the upper end thereof. The pin receiving holes 70 are generally alignable with the pin receiving holes 54 in the hanger body 12. The slip bowl 16 has an internal support shoulder 74 formed thereon near the upper end of the slip bowl 16. Below the support shoulder 74, the slip bowl 16 is configured to have a straight portion 75 extending downward a distance perpendicular from the support shoulder 74 and a tapered portion 76 extending downward from the straight portion 75 to the lower end of the slip bowl 16. The tapered portion 76 is tapered inwardly relative to vertical at an angle of from about 3° to about 15°.

The slip segments 18 are generally wedge-shaped members characterized as having an upper end 82, a lower end 84, an outer surface 86, and an inner surface 88. The outer surface 86 of each slip segment 18 is curved to conform to the shape of the slip bowl 16 and has a straight portion 89 corresponding to the straight portion 75 of the slip bowl 16 and a tapered portion 90 corresponding to the tapered portion 76. The outer surface 86 of each slip segment 18 further has a protrusion 92 extending therefrom. The protrusion 92 is adapted to support the slip segment 18 on the support shoulder 74 of the slip bowl 16. A vertically extending pin receiving slot 93 is provided in the outer surface 86 of each slip segment 18 between the protrusion 92 and the upper end 82. The pin receiving slot 93 serves to register one of the slip setting pins 20 with the center of one of the slip segments 18 in a manner described below.

The inner surface 88 of each slip segment 18 has a curved configuration such that the slip segments 18 define a slip bore 80 (FIG. 2) when the slip segments are disposed in the slip bowl 16. The inner surface 88 has a first set of serrations 94 and a second set of serrations 95 formed therein. The first set of serrations 94 is configured for bi-directional gripping engagement with the coiled tubing, while the second set of serrations 95 is configured for uni-directional gripping engagement with the coiled tubing. The first set of serrations 94 is formed in the inner surface 88 of each slip segment 18 near the upper end 82 opposite the pin engaging surface of the outer surface 86 of the slip segments 18 and has a horizontal orientation for biting into the coiled tubing in such a manner that the coiled tubing will not have a tendency to slip if either an upward or downward force is applied to the coiled tubing. The second set of serrations 95 is formed on the inner surface 88 of each slip segment 18 opposite the straight portion 75 of the outer surface 86 below the protrusion 92 and opposite the tapered portion 76 and has an upwardly angled orientation for supporting the coiled tubing when a downward force is applied to the coiled tubing while allowing sliding engagement when an upward force is applied to the coiled tubing.

Figure 7:
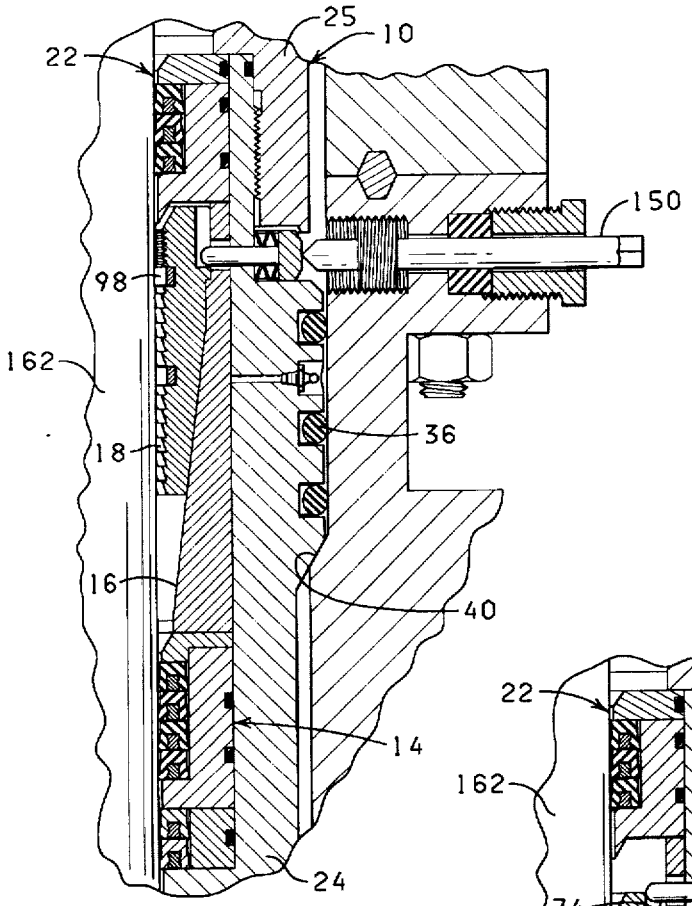
FIG. 7 is an elevational view, partially in cross section, showing the slip segments in the retracted position.
Figure 8:
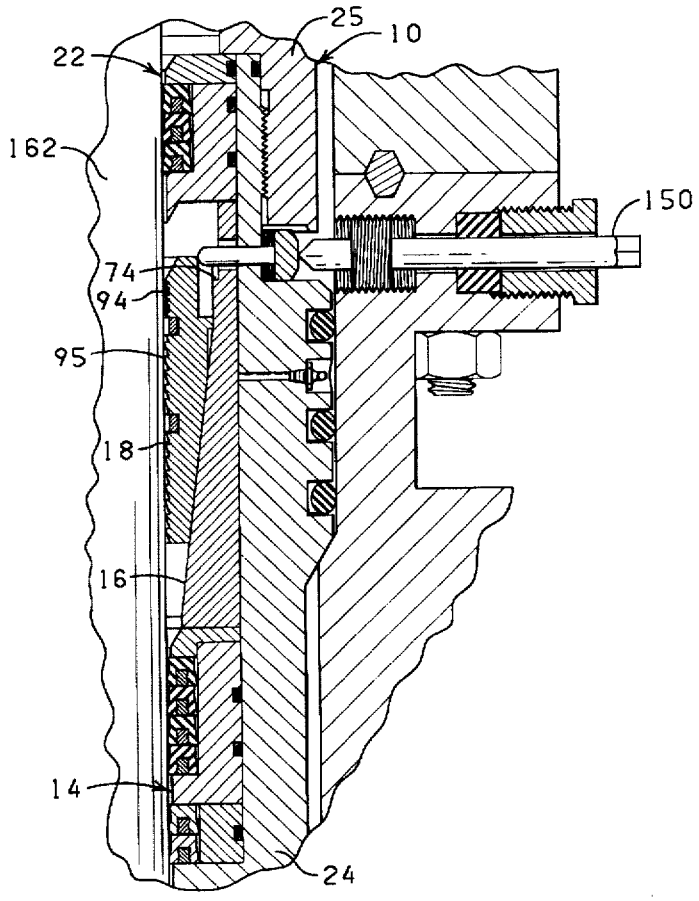
FIG. 8 is an elevational view, partially in cross section, showing the slip segments in the extended position.
Figure 3:
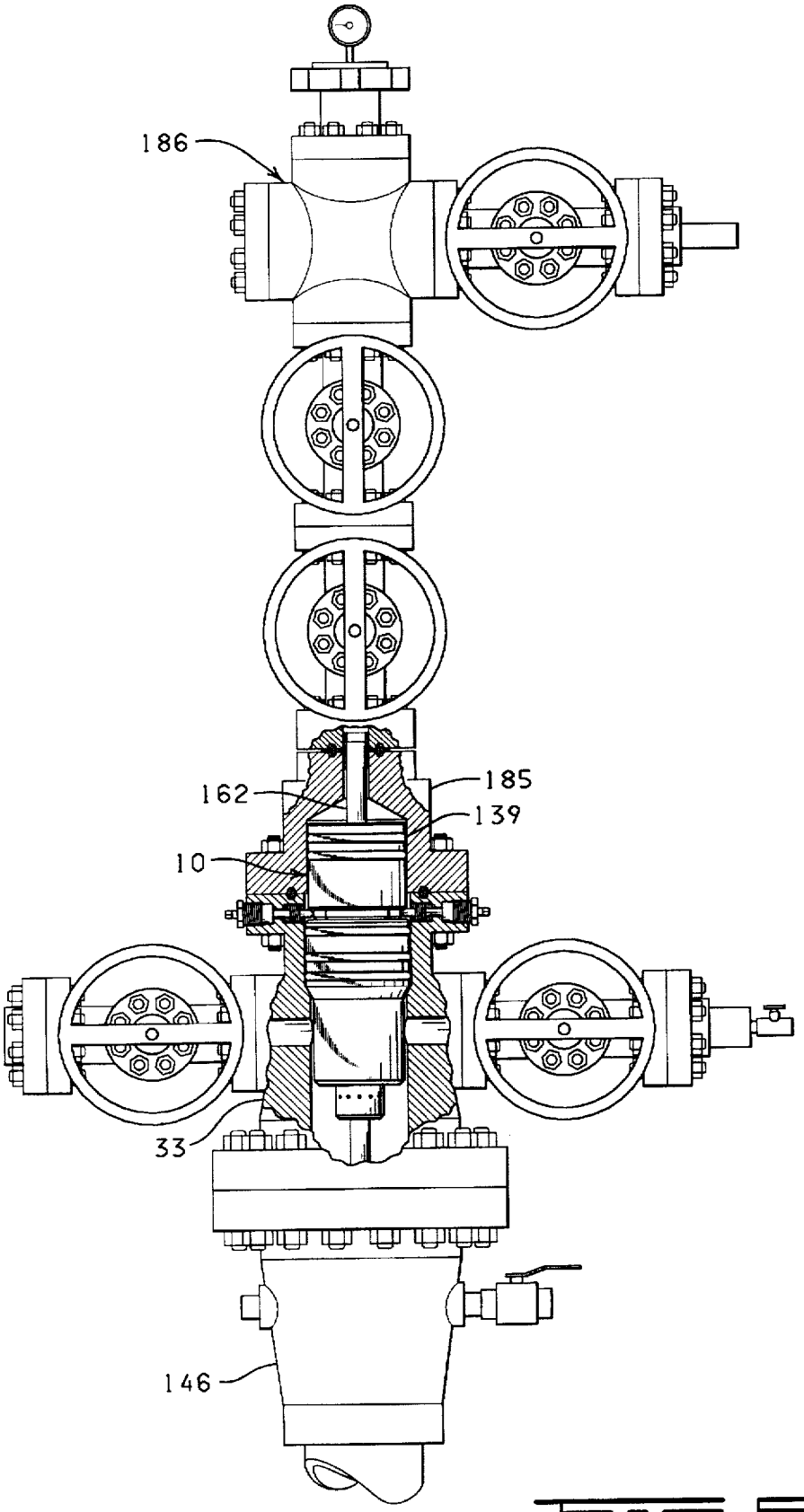

The slip segments 18 are movable between a retracted position (FIGS. 2 and 7) and an extended position (FIG. 8). In the retracted position, the slip segments 18 are biased radially outward and supported on the support shoulder 74 via the protrusions 92 whereby a coiled tubing string is able to be passed through the slip bore 80 defined by the slip segments 18. In the extended position, the slip segments 18 are urged radially inward wherein the protrusion 92 clears the support shoulder 74 of the slip bowl 16 and the first set of serrations 94 grippingly engages the coiled tubing. A downward force on the coiled tubing causes the slip segments 18 to slide downwardly along the tapered portion 76 of the slip bowl 16 thereby wedging the slip segments 18 between the slip bowl 16 and the coiled tubing to cause the second set of serrations 95 to grippingly engage the coiled tubing. As will be described in greater detail below in reference to FIG. 8, the protrusion 92 of the slip segments 18 and the straight portion 75 of the slip bowl 16 are dimensioned to cooperate such that the protrusion 92 will not come into contact with the tapered portion 76 of the slip bowl 16 but slide adjacent the straight portion 75 as the slip segments 18 are being wedged into the slip bowl 16. Thus, substantially the entire surface area of the tapered portion 90 of the slip segments 18 is able to remain engaged with the tapered portion 76 of the slip bowl 16 so as to provide a uniform grip about the coiled tubing and thereby prevent point loading on the coiled tubing when the slip segments 18 are wedged between the slip bowl 16 and the coiled tubing.

The upper end 82 of each slip segment 18 has a beveled surface 96 to aid in disengaging the slip segments 18 from the coiled tubing when the slip segments 18 are moved from the extended position to the retracted position in a manner to be described in greater detail below.

The slip segments 18 are biased in the retracted position with a pair of slip retaining springs 98 disposed in the inner surface 88 of the slip segments 18. More particularly, each slip segment 18 is provided with a pair of spring retaining grooves 100 formed across the inner surface 88 of the slip segments 18. The grooves 100 of one slip segment 18 cooperate with the grooves 100 of the other slip segments 18 to receive the slip retaining springs 98.

The upper seal assembly 22 is disposed in the hanger body 12 above the slip bowl 16 and the slip segments 18 are supported on the upper end of the slip bowl 16. The upper seal assembly 22 includes a lower ring 102, an upper ring 104, and a plurality of seal members 106. The lower ring 102 is supported by the upper end of the slip bowl 16 and is provided with a pair of annular grooves 108 for receiving an O-ring 110 (FIG. 2) for sealingly engaging the internal side of the hanger body 12. The lower ring 102 has a recess 116 formed on the upper side thereof for receiving the seal members 106. The lower ring 102 further has a lip 118 configured to cooperate with the beveled surface 96 of the slip segments 18 to force the slip segments 18 to the retracted position when the slip segments 18 are pulled upwardly into engagement with the lip 118.

The upper ring 104 is disposed on the lower ring 102 and is provided with an annular groove 120 for receiving an O-ring 122 (FIG. 2) for sealingly engaging the internal surface 28 of the hanger body 12. The upper side of the upper ring 104 is provided with a beveled surface 126 to facilitate insertion of the coiled tubing. The seal members 106 are disposed in the annular recess 116 formed by the lower ring 102 so as to form a fluid tight seal between the upper ring 104, the lower ring 102 and the coiled tubing. The seal members 106 are similar to the seal members 65 of the lower seal assembly 14.

The setting pins 20 are utilized to selectively activate and deactivate the slip segments 18. The setting pins 20 are slidingly disposed through the aligned pin receiving holes 54 and 70 of the hanger body 12 and the slip bowl 16, respectively. The pins 20 are disposed in the pin receiving slots 93 and engagable against the outer surface 86 of the slip segments 18 such that the slip segments 18 are disposed in the extended position when the pins 20 are urged inwardly and such that the slip segments 18 are biased in the retracted position by the slip retainer springs 98 when the pins 20 are outwardly positioned.

Each pin 20 includes a head portion 132 and a shaft portion 134. The shaft portion 134 extends through the pin receiving holes 54 and 70 and engages the outer surface 86 of the adjacent slip segments 18. The shaft portion 134 of each pin 20 is longitudinally dimensioned such that the pins 20 cause the first set of serrations 94 to grip into the coiled tubing but the pins 20 are unable to be run inwardly so as to cause the coiled tubing to deform or collapse. In other words, the head portion 132 serves as a limit stop to prevent an operator from applying excess force to the coiled tubing. The head portions 132 of the pins 20 are elongated so that the head portions 132 of the pins 20 extend annularly about the hanger body 12 in an end-to-end relationship so as to be engagable by a set of lock pins provided with the tubinghead 33 as will be further detailed below.

Each of the pins 20 are biased outwardly by a spring 131 disposed between the hanger body 12 and the head portion 132. An example of a suitable spring is a Belleville spring.

The upper body portion 25 of the hanger body 12 is threadingly connected to the threaded portion 50 of the lower body portion 24 so as to function as a cap. The upper body portion 25 is provided with a pair of external annular grooves 138, each for receiving an O-ring 139 (FIG. 2). The upper body portion 25 is further provided with an internal threaded bore 140 to facilitate removal of the coiled tubing hanger 10 from the tubinghead 33. The upper body portion 25 has a pin retaining lip 143 which extends over a portion of the head portion 132 of the pins 20 to retain the pins 20 in the hanger body 12.

Figure 3:
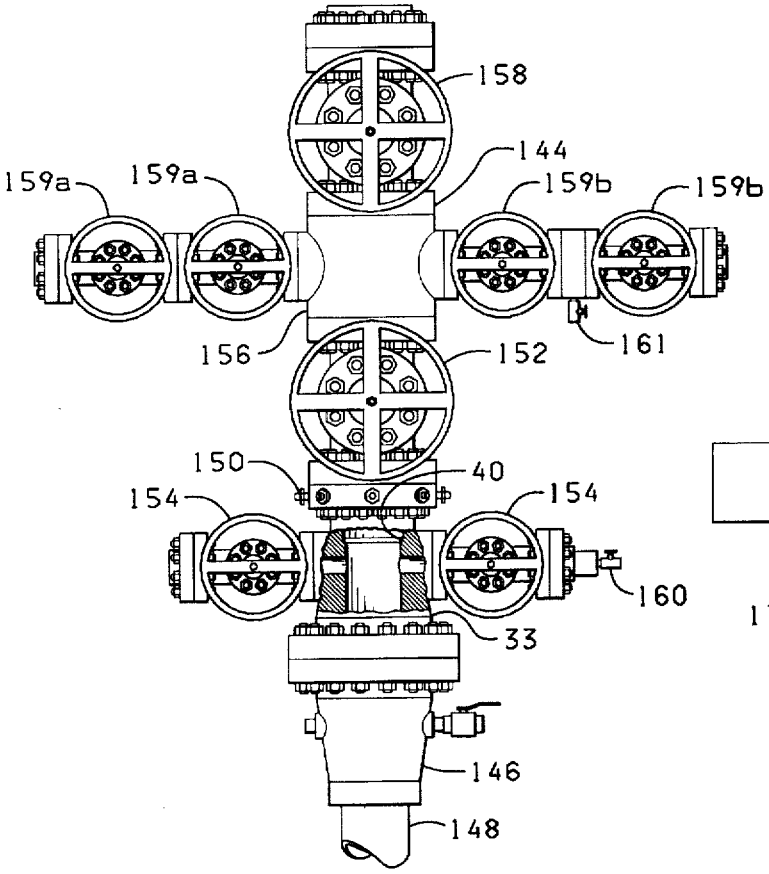
FIG. 3 is an elevational view of a typical wellhead configuration for use in the installation of the internal coiled tubing hanger of the present invention.

FIGS. 3–11 illustrate the installation and operation of the coiled tubing hanger 10 described above. FIG. 3 is an elevational view of a typical wellhead configuration 144 that can be used to install the coiled tubing hanger 10. The wellhead configuration 144 includes a casinghead 146, the tubinghead 33, and various valves and fittings for controlling well pressure.

The casinghead 146 is supported by a surface pipe 148 and functions to support a casing string (not shown) which is extended down the well bore to provide a permanent bore hole through which productions operations may be conducted.

The tubinghead 33 is connected to the casinghead 146 in a conventional manner. The tubinghead 33 usually supports a tubing string which is suspended within the casing string. A set of lock pins 150, normally for holding a conventional tubing hanger in the tubinghead 33 are threadingly extended into the tubinghead 33.

Various combinations of valves and fittings can be installed above the tubinghead 33 to control the internal pressure of the wellhead configuration 144 during installation of the coiled tubing hanger 10. FIG. 3 illustrates one such valve configuration which includes a master valve 152 connected above the tubinghead 33 and a pair of wing valves 154 connected to the sides of the tubinghead 33. The valve configuration further includes a cross 156 connected to the master valve 152 with another master valve 158 connected above the cross 156 and a series of wing valves **159*a* and 159*b* extending from the sides of the cross 156. One of the wing valves 154 is provided with a valve which defines a lower equalizing port 160 and a valve is interposed between a pair of the wing valves 159*b* so as to define an upper equalizing port 161 thereby enabling the well pressure to be equalized from the wing valve 154 on the tubinghead 33 to a point above the coiled tubing hanger 10** as will be further described hereinbelow.

Figure 4:
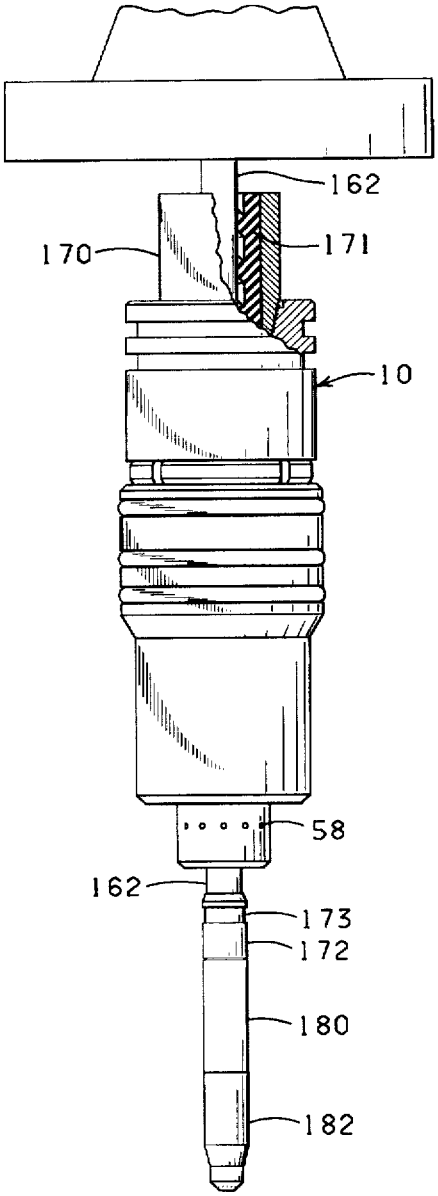
FIG. 4 is an elevational view of the coiled tubing shown with the internal coiled tubing hanger suspended above the end of the internal coiled tubing illustrating a coiled tubing connector, valve and nozzle.
Figure 5:
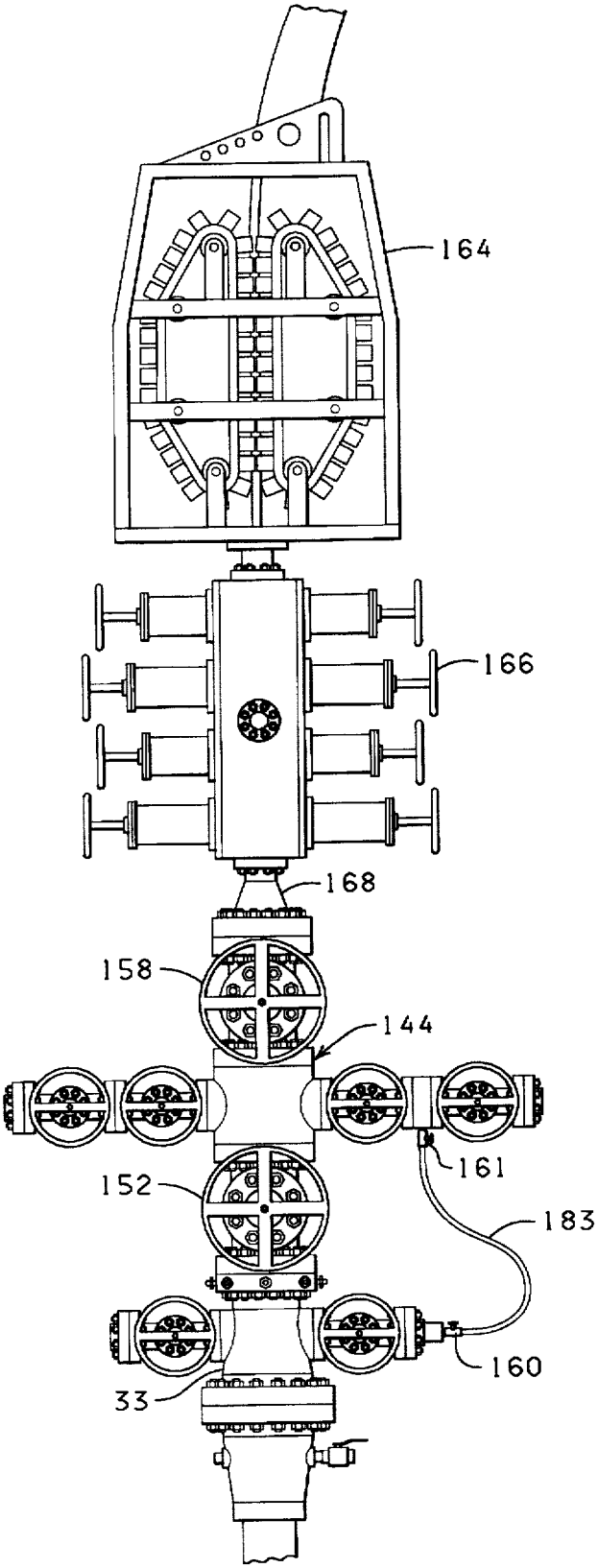
FIG. 5 is an elevational view showing an injector unit, a blowout preventer stack, and a spool connected to the wellhead configuration.
Figure 5:
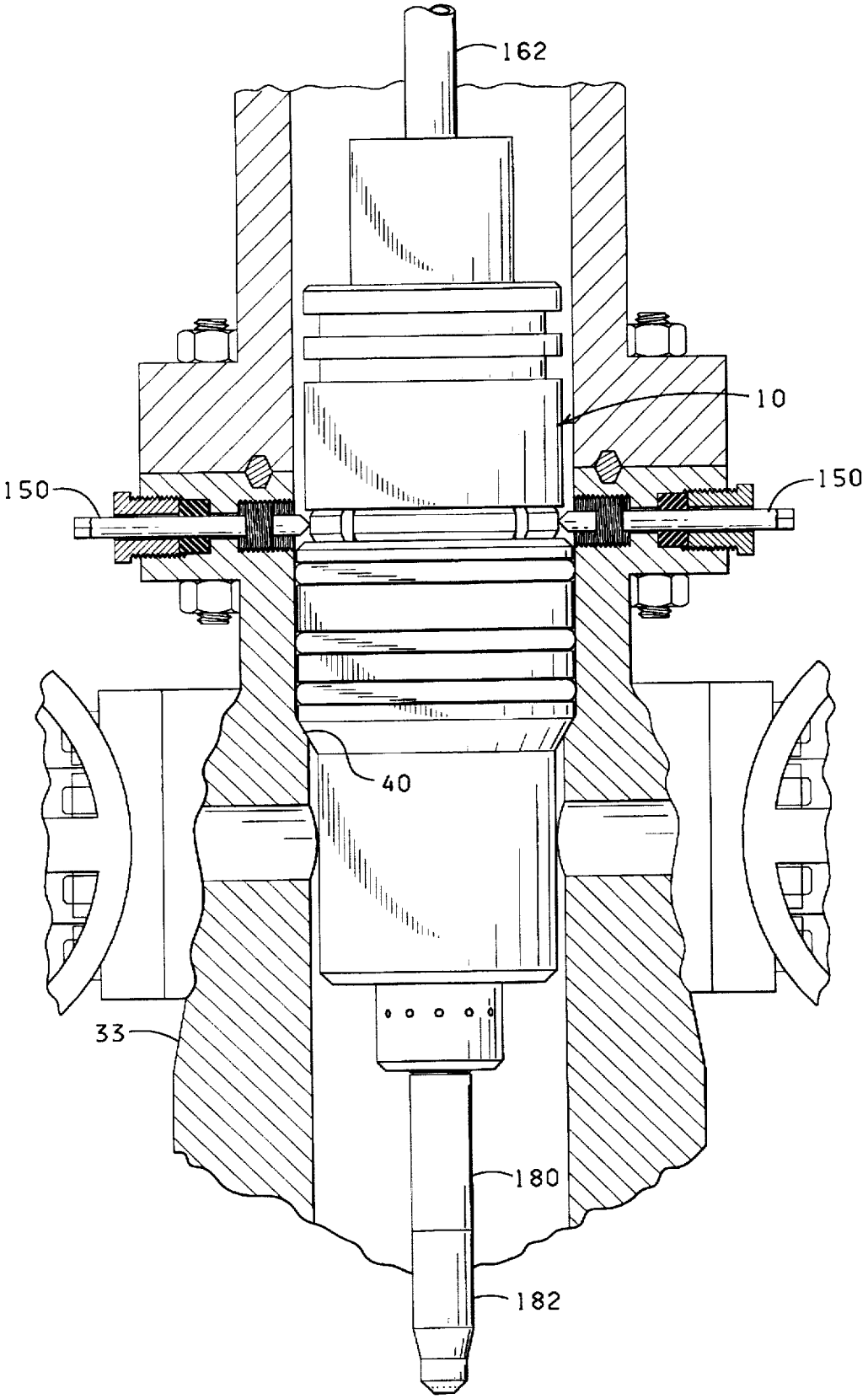

Referring now to FIGS. 4 and 5, the coiled tubing hanger 10 is run into the tubinghead 33 on the end of a string of coiled tubing 162 (referred to hereinafter as "coiled tubing 162"). The coiled tubing 162 is run into the well bore with a conventional injector unit 164 (FIG. 5) and a blowout preventer stack 166 (FIG. 5). The injector unit 164 is adapted to frictionally engage the coiled tubing 162 to provide the thrust to snub the coiled tubing 162 into the well bore and to control the rate of entry into the well bore. The blowout preventer stack 166 is utilized for pressure control and is connected to the upper end of the wellhead configuration 144 in any suitable manner, such as with a spool 168.

To install the coiled tubing hanger 10 on the end of the coiled tubing 162, the coiled tubing 162 is first run through the injector unit 164 and the blowout preventer stack 166 until the coiled tubing 162 extends downwardly therefrom approximately five to seven feet. As shown in FIG. 4, a pipe wiper assembly 170 provided with a wiper element 171 is threaded onto the upper body portion 25 of the coiled tubing hanger 10 and the combination of the coiled tubing hanger 10 and the pipe wiper assembly 170 is then disposed on the end of the coiled tubing 162 and suspended a distance above the end of the coiled tubing 162. Prior to disposing the coiled tubing hanger 10 on the coiled tubing 162, the slip segments 18 of the coiled tubing hanger 10 are placed in the retracted position and the external surface 26 of the hanger body 12 is lubricated.

A coiled tubing connector 172, best illustrated in FIG. 4, is connected to the end of the coiled tubing 162 to facilitate the connection of the coiled tubing hanger 10 to the coiled tubing 162. The coiled tubing connector 172 is a tubular member provided with an external annular groove 173 for receiving the shear screws 58 in an interlocking relation so as to support the coiled tubing hanger 10 on the coiled tubing 162 as the coiled tubing hanger 10 is run into the tubinghead 33. With the coiled tubing connector 172 attached to the coiled tubing 162, the coiled tubing hanger 10 is lowered onto the coiled tubing connector 172 and the shear screws 58 located near the lower end 32 of the hanger body 12 are screwed in until snug against the coiled tubing connector 172. A conventional pump off check valve 180 and a wash down nozzle 182 are connected to the coiled tubing connector 172.

With the coiled tubing hanger 10 secured to the end of the coiled tubing 162, the coiled tubing 162 is pulled up by the operator until the coiled tubing hanger 10 is flush with the bottom flange of the spool 168. The distance the coiled tubing hanger 10 must be lowered to set the coiled tubing hanger 10 in the tubinghead 33 is then measured and the distance marked on the coiled tubing 162 where it can be easily seen by the operator.

To install the coiled tubing hanger 10 in the tubinghead 33, the injector unit 164 and the blowout preventer stack 166 are connected to the wellhead configuration 144 as substantially shown in FIG. 5. The coiled tubing 162 is then run into the well bore until the coiled tubing hanger 10 is positioned below the upper equalizing port 161. The lower and upper equalizing ports 160 and 161, which are fluidly interconnected by an equalizing line 183, are then opened and the master valves 152 and 158 and the blowout preventer stack 166 are fully opened.

To clean sand, boxite and other debris from the valves and wellhead components that may damage the O-rings of the coiled tubing hanger 10, the coiled tubing 162 is loaded with approximately ten barrels of fluid (water and surfactant, for example) and ejected from the wash down nozzle 182 as the coiled tubing hanger 10 is snubbed through the wellhead configuration 144 to the tubinghead 33. The fluid can be forced from the coiled tubing 162 by using nitrogen in a manner well known in the art.

The coiled tubing 162 is lowered until the coiled tubing hanger 10 is landed in the tubinghead bowl 40 (FIG. 6). The coiled tubing injection rate and pounds of force are monitored as the coiled tubing hanger 10 is lowered into the tubinghead 33 in order not to prematurely shear the shear screws 58. To this end, 50% of the shear out force of the shear screws 58 should not be exceeded. An increase in pressure will be indicated when the coiled tubing hanger 10 is set in the tubinghead bowl 40 (FIG. 6) of the tubinghead 33.

Referring now to FIGS. 7 and 8, with the coiled tubing hanger 10 landed in the tubinghead bowl 40 of the tubinghead 33, the lock pins 150 on the tubinghead 33 are run inwardly in equal increments and in sequential order until tight. Each lock pin 150 is then backed out approximately two turns or one-quarter inch thus retaining the coiled tubing hanger 10 in the tubinghead bowl 40 of the tubinghead 33 and positioning the slip segments 18 in the retracted position (FIG. 7) whereby the slip segments 18 are biased away from the coiled tubing 162 such that the coiled tubing 162 is able to pass freely through the coiled tubing hanger 10.

The lower and upper equalizing ports 160 and 161 are then closed, and the wellhead configuration 144 above the coiled tubing hanger 10 is pressurized between 3,000 to 5,000 psi for approximately 5 to 15 minutes to test the seal formed about the coiled tubing 162 by the coiled tubing hanger 10.

Thereafter, the operator slowly lowers the coiled tubing 162 to shear the shear screws 58 out of the coiled tubing connector 172 (shear force is approximately 3,500 to 7,000 psi). At this point, the operator runs the coiled tubing 162 to the desired depth by the coiled tubing 162 passing through the coiled tubing hanger 10 while the upper and lower seal assemblies 22 and 14 in cooperation with the O-rings 36 provide a fluid tight seal about the downwardly moving coiled tubing 162, thereby providing complete pressure control even while the well remains alive.

To hang the coiled tubing 162 from the coiled tubing hanger 10, the lock pins 150 of the tubinghead 33 are run inward in equal increments and in sequential order to move the first set of serrations 94 into gripping engagement with the coiled tubing 162 and in turn move the slip segments 18 off of the support shoulder 74 of the slip bowl 16. The operator then slowly applies a downward force of approximately 2,000 psi to the coiled tubing 162 causing the slip segments 18 to slide downwardly along the slip bowl 16 until the second set of serrations 95 grippingly engage the coiled tubing 162 and the slip segments 18 are wedged between the slip bowl 16 and the coiled tubing 162. With the slip segments 18 set in the slip bowl 16, the slip setting pins are retightened so as to engage the upper end of the slip segments 18 and prevent the slip segments 18 from being spread apart if the coiled tubing 162 is forced or buckled upward by formation pressure.

Next, the upper and lower equalizing ports 161 and 160 are closed and the pressure above the coiled tubing hanger 10 is vented and the seal formed by the coiled tubing hanger 10 is tested. The pressure above the coiled tubing hanger 10 and in the coiled tubing 162 are bled down and the injector unit 164, the blowout preventer stack 166 and the valves 152, 154, 158, and 159 are removed from the tubinghead 33. Next, a rough cut is made on the coiled tubing 162 and the wiper assembly 170 is removed from the coiled tubing hanger 10. The coiled tubing 162 extending above the coiled tubing hanger 10 is then measured and cut to the desired length and O-rings 139 are installed in the annular grooves formed in the upper body portion 25.

As illustrated in FIG. 9, an adapter flange 185 configured to receive the upper end of the coiled tubing 162 is connected to the tubinghead 33. Next, a ball (not shown) is dropped through the coiled tubing 162 to the pump off check valve 180. Finally, a christmas tree assembly 186 is installed and pressure is applied to pump out the check valve 180 and the wash down nozzle 182, whereby the well is ready for production.

When it is desired to remove the coiled tubing 162 or merely reposition the coiled tubing 162 in the well bore, the christmas tree 186 and the adapter flange 185 are first removed. With the coiled tubing 162 connected to the injector unit 164, the lock pins 150 are run outward so as to cause the slip setting pins to bias outward. The coiled tubing 162 can then be lifted upward thereby causing the beveled surface 96 of the slip segments 18 to engage the lip 118 of the lower spacer ring 102 and force the slip segments 18 away from the coiled tubing 162 and disengage the first and second set of serrations 94, 95. The slip segments 18 are biased in the retracted position and supported in the slip bowl 16 on the internal support shoulder 74 thereof.

As briefly mentioned above, the configuration of the slip segments 18 and the slip bowl 16 of the present invention cooperate to provide uniform gripping pressure across substantially the entire inner surface 88 of the slip segments 18. That is, the shallow angle of the taper together with the length of the taper prevent the slip segments 18 from point loading the coiled tubing 162 which in turn can result in the distortion and collapse of the coiled tubing 162. The use of two differently configured sets of serrations provides a strong hold on the coiled tubing 162 as it is suspended from the wellhead without shearing the coiled tubing 162 while maintaining a strong hold on occasions when the coiled tubing 162 is forced upward during operations. The protrusion 92 of the slip segments 18 and the support shoulder 74 of the slip bowl 16 are configured to enable the slip segments 18 to be retracted from the coiled tubing 162 without requiring the coiled tubing hanger 10 to be disassembled. Furthermore, complete pressure control is maintained by the lower and upper seal assemblies 14 and 22 without requiring the killing of the well or the use of a mechanical or hydraulic access window.

Figure 10:
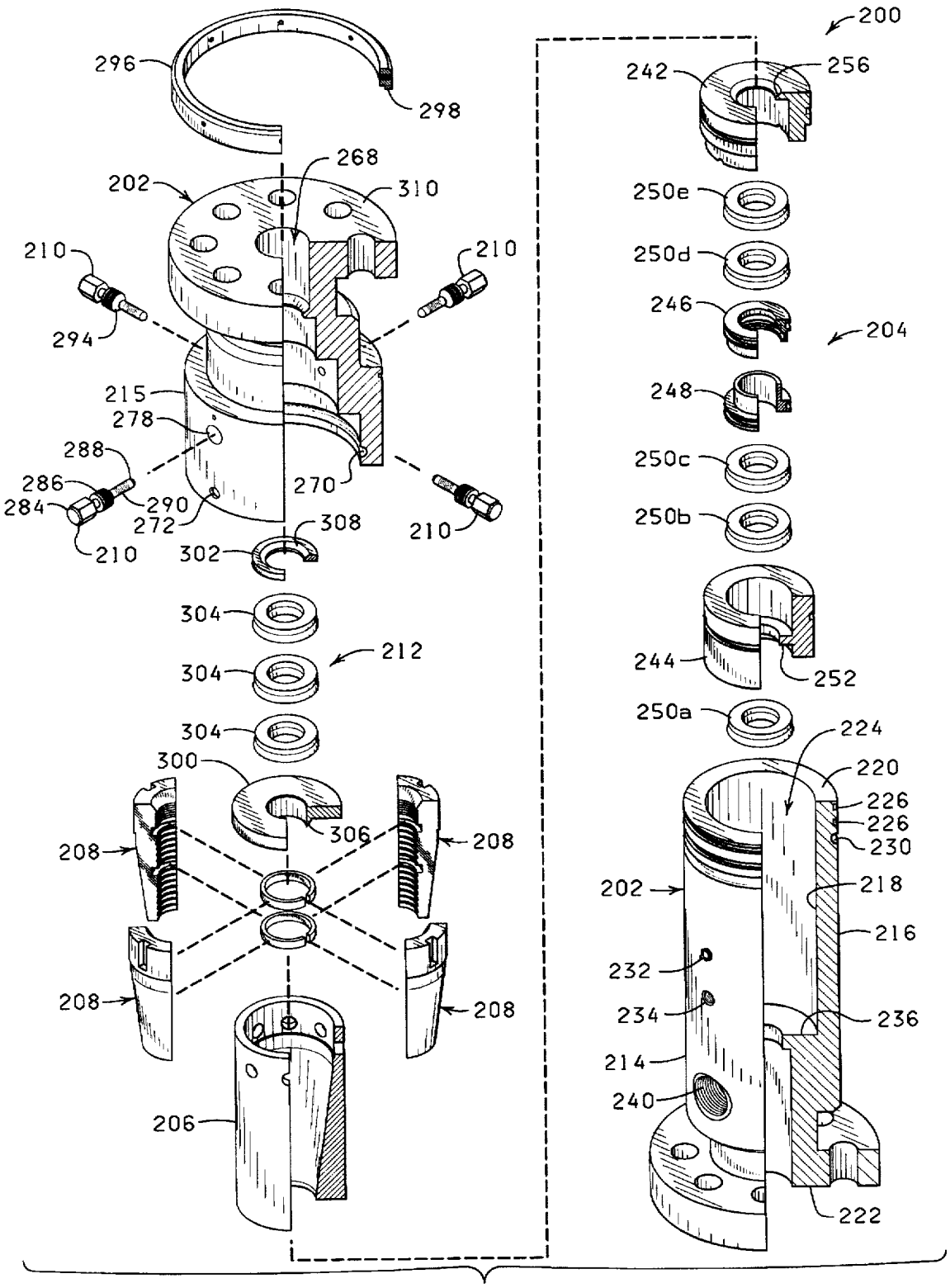
FIG. 10 is a partially cutaway, exploded view of an external coiled tubing hanger constructed in accordance with the present invention.
Figure 11:
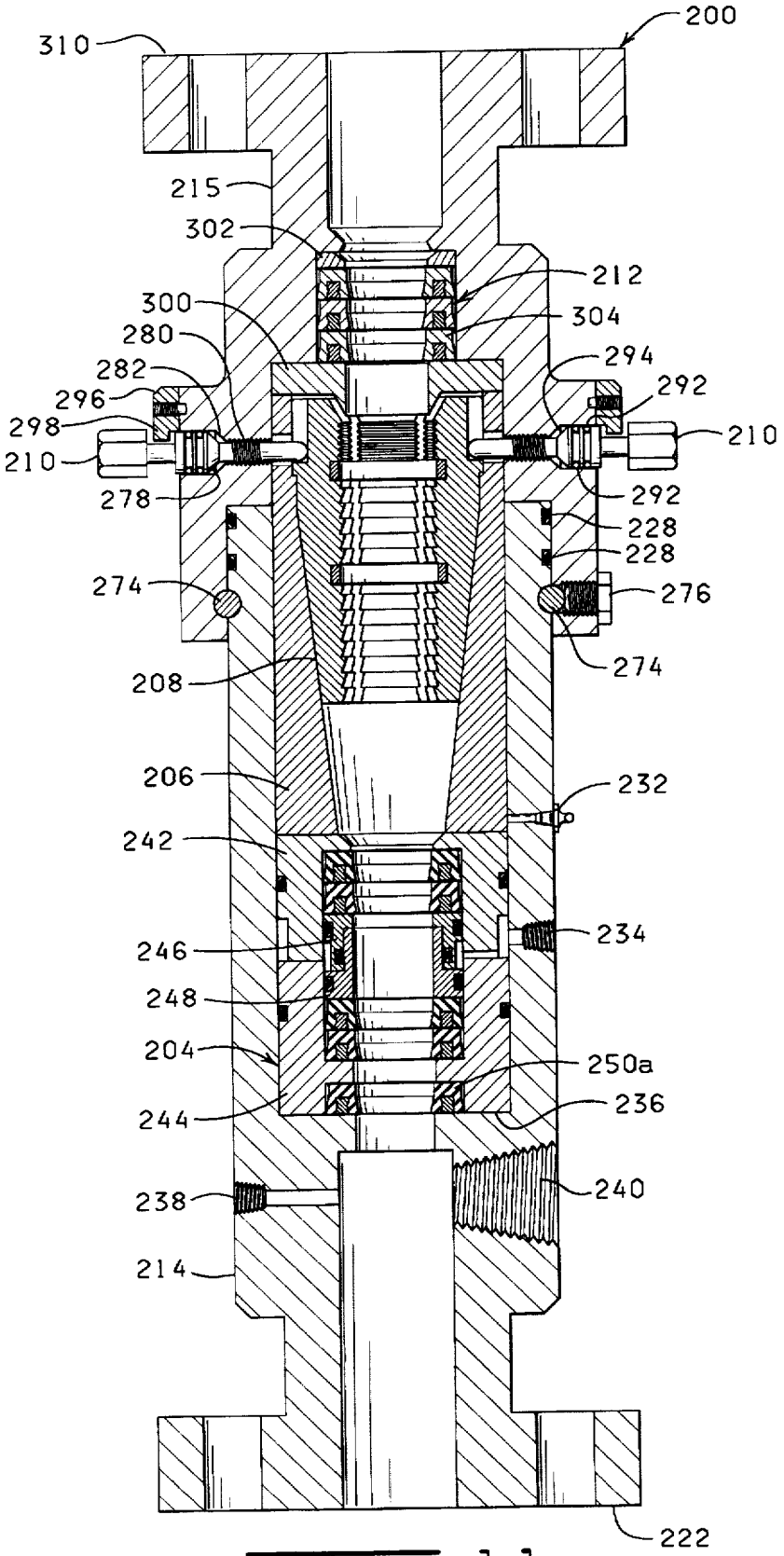
FIG. 11 is an elevational view, partially in cross section, showing the external coiled tubing hanger of FIG. 10 assembled.
Figure 12:
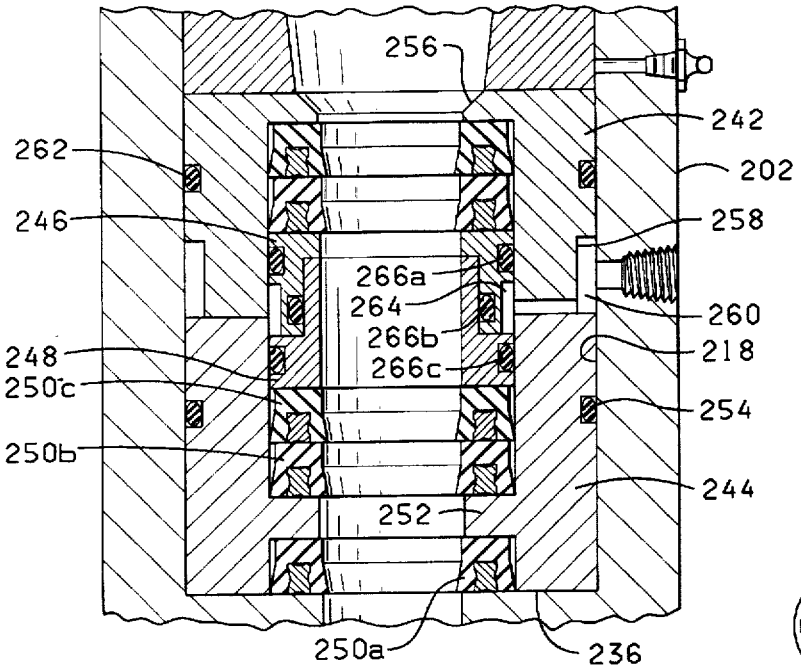
FIG. 12 is an elevational view of a lower seal assembly used in the external coiled tubing hanger of FIG. 10.

FIGS. 10–12 show an external coiled tubing hanger 200 constructed in accordance with the present invention. The coiled tubing hanger 200 is adapted to be disposed in a wellhead assembly as a self-contained unit, as opposed to being positioned in a tubinghead. The coiled tubing hanger 200 includes a hanger body 202, a lower seal assembly 204, a slip bowl 206, a plurality of slip segments 208, a plurality of slip segment setting pins 210, and an upper seal assembly 212.

The hanger body 202 includes and lower body portion 214 and an upper body portion 215. The lower body portion 214 has an external surface 216, an internal surface 218, an upper end 220, and a lower end 222. The internal surface 218 of the lower body portion 214 defines a bore 224 extending between the upper end 220 and lower end 222. The lower body portion 214 is provided with a pair of grooves 226 near the upper end thereof for receiving a pair of O-rings 228 (FIG. 11) and providing a fluid tight seal between the hanger body 202 and the upper body portion 215. The lower body portion 214 is further provided with a groove 230 which functions as a race as will be further detailed below.

The lower body portion 214 is provided with a grease fitting 232 to enable the coiled tubing hanger 200 to be lubricated when necessary and a port 234 for energizing the lower seal assembly 204 in a manner to be described in detail below. The lower body portion 214 has an internal support shoulder 236.

The lower end 222 of the lower body portion 214 is shown to be adapted for a flanged connection with the wellhead assembly. However, it will be appreciated by those of ordinary skill in the art that the lower end 222 of the hanger body 202 could also be configured with a threaded portion for a threaded connection. The hanger body 202 can also be provided with outlets 238 and 240.

The lower seal assembly 204 is disposed in the hanger body 202 and supported on the internal support shoulder 236 of the lower body portion 214. The lower seal assembly 204 includes an upper spacer ring 242, a lower spacer ring 244, an upper energizing ring 246, a lower energizing ring 248, and a plurality of seal members 250.

Because of the excessive wear experienced by seal members when running coiled tubing into a well bore, the lower seal assembly 204 is adapted to form a fluid tight seal about the coiled tubing with one of the seal members **250*a* while the coiled tubing is being run into the well bore, but also isolate other seal members 250*b*–*e* from excessive wear. The isolated seal members 250*b*–*e* can in turn be hydraulically energized once the coiled tubing is suspended from the coiled tubing hanger 200** to ensure a fluid tight seal is formed about the coiled tubing during production operations.

As best illustrated in FIGS. 10 and 12, the lower spacer ring 244 is a ring shaped member having an inward protrusion 252. The lower spacer ring 244 is positioned on the internal support shoulder 236 with the seal member **250*a* disposed between the internal support shoulder 236 and the protrusion 252 and the seal members 250*b* and 250*c* positioned above the protrusion 252. The protrusion 252 serves to isolate the seal member 250*a* from the seal members 250*b* and 250*c*. The lower spacer ring 244 is adapted to receive an O-ring 254 in the outer surface thereof to form a fluid tight seal between the lower spacer ring 244 and the internal surface 218 of the hanger body 202**.

The upper spacer ring 242 has an upper beveled lip 256 and an outer annular recess 258 which cooperates with the internal surface 218 of the hanger body 202 to define a void 260 (FIG. 12) in fluid communication with the port 234 in the hanger body 202. The upper spacer ring 242 is provided with an O-ring 262 to provide a fluid tight seal between the outer surface of the upper spacer ring 242 and the internal surface 218 of the hanger body 202. The upper spacer ring 242 is disposed on the lower spacer ring 244 such that the beveled lip 256 of the upper spacer ring 242 cooperates with the protrusion 252 of the lower spacer ring 244 to define a recess for receiving the seal members **250*b* and 250*c*, the lower energizing ring 248, the upper energizing ring 246, the seal member 250*d*, and the seal member 250*e*. More specifically, the seal members 250*b* and 250*c* and the seal members 250*d* and 250*e* are stacked on top of one another with the upper and lower energizing rings 246 and 248 positioned between the seal members 250*c* and 250*d***.

The upper and lower energizing rings 246, 248 are configured for reciprocating movement relative to one another. That is, the upper energizing ring 246 has a substantially T-shaped cross section and the lower energizing member 248 has a substantially L-shaped cross section. To this end, a void 264 is provided between the upper energizing ring 246 and the upper spacer ring 242. The void 264 is in fluid communication with the void 260 and the port 234 such that when hydraulic fluid is injected into the void 260 and the void 264 and pressurized, the upper and lower energizing rings 246 and 248 expand whereby the upper energizing ring 246 cooperates with the beveled lip 256 of the upper spacer ring 242 to energize the seal members 250*d* and 250*e* and the lower energizing ring 248 cooperates with the protrusion 252 of the lower spacer ring 244 to energize the seal members 250*b* and 250*c*. The void 264 is further sealed with O-rings 266*a*, 266*b*, and 266*c* as substantially shown in FIG. 12.

It will be appreciated by those of ordinary skill in the art that the lower seal assembly 204 can be utilized in the coiled tubing hanger 10 described above by disposing a bore through the tubinghead 33 which is in fluid communication with the lower seal assembly 204 so as to enable the seal members to be energized.

The slip bowl 206 is disposed in the hanger body 202 and supported on the upper spacer ring 242 of the lower seal assembly 204. The construction of the slip bowl 206 and the slip segments 208, as well as the relationship of the slip bowl 206 to the slip segments 208, is identical to that described above in reference to the coiled tubing hanger 10. Therefore, for the sake of brevity, such description will not be repeated, but such description is expressly incorporated herein by reference.

The upper body portion 215 has an internal bore 268 extending therethrough from the upper end to the lower end. The internal bore 268 is configured to receive the lower body portion 214, the slip bowl 206 and the upper seal assembly 212 substantially as shown in FIG. 11. The upper body portion 215 is provided with an internal annular groove 270 which is positioned adjacent the groove 230 of the lower body portion 214 when the upper body portion 215 is positioned on the lower body portion 214. The internal annular groove 270 functions as a race such that the groove 270 and the groove 230 cooperate to define an annular ball receiving groove. The upper body portion 215 is provided with a hole 272 extending from the external surface to the ball receiving groove. To secure the upper body portion 215 to the hanger body 202, a plurality of steel balls 274 are inserted into the ball receiving groove via the hole 272 thereby causing the upper body portion 215 to be rotatably interlocked with the lower body portion 214 to permit the slip setting pins 210 to be properly aligned with the slip segments 208. The O-rings 228 provide a fluid tight seal between the lower body portion 214 and the upper body portion 215. The balls 274 are retained in the ball receiving groove with a cap or plug 276 secured in the hole 272.

The upper body portion 215 is provided with a plurality of pin receiving holes 278 which are alignable with the pin receiving holes of the slip bowl 206. Each of the pin receiving holes 278 is configured to receive one of the slip setting pins 210. The pin receiving holes 278 are provided with a threaded portion 280 and a tapered portion 282 (FIG. 11).

The slip setting pins 210 have a head 284, a sealing portion 286, and a shaft 288 having a threaded portion 290. The sealing portion 286 includes a pair of O-rings 292 (FIG. 11) and a tapered surface 294 configured to sealingly mate with a tapered portion 282 of the pin receiving holes 278 to form a metal-to-metal seal when the slip setting pins 210 are fully tightened.

The slip setting pins 210 are retained in the upper body portion 215 with a retainer ring 296. The retainer ring 296 has a downwardly extending lip 298, and the retainer ring 296 is dimensioned to be secured to the upper body portion 215 such that the downwardly extending lip 298 extends between the head 284 and the sealing portion 286 of the slip setting pins 210. The retainer ring 296 is secured to the upper body portion 215 in any suitable manner, such as with a plurality of studs.

The upper seal assembly 212 is disposed in the upper body portion 215 and supported on the slip bowl 206. The upper seal assembly 212 includes a lower ring 300, an upper ring 302, and a plurality of seal members 304. The lower ring 300 is disposed on the upper end of the slip bowl 206 and is provided with a lip 306 configured to cooperate with the beveled surface of the slip segments 208 to the retracted position when the slip segments 208 are pulled upwardly into engagement with the lip 306.

The seal members 304 are stacked on the lower ring 300 (three seal members 304 are shown herein) with the upper ring 302 positioned on the seal members 304. The upper ring 302 has an internal beveled surface 308 to facilitate insertion of the coiled tubing through the coiled tubing hanger 200.

The upper body portion 215 is further provided with a flanged portion 310 for connecting additional wellhead components above the coiled tubing hanger 200. It will be realized that the upper body portion 215 can also be configured for threaded connection.

Figure 13:
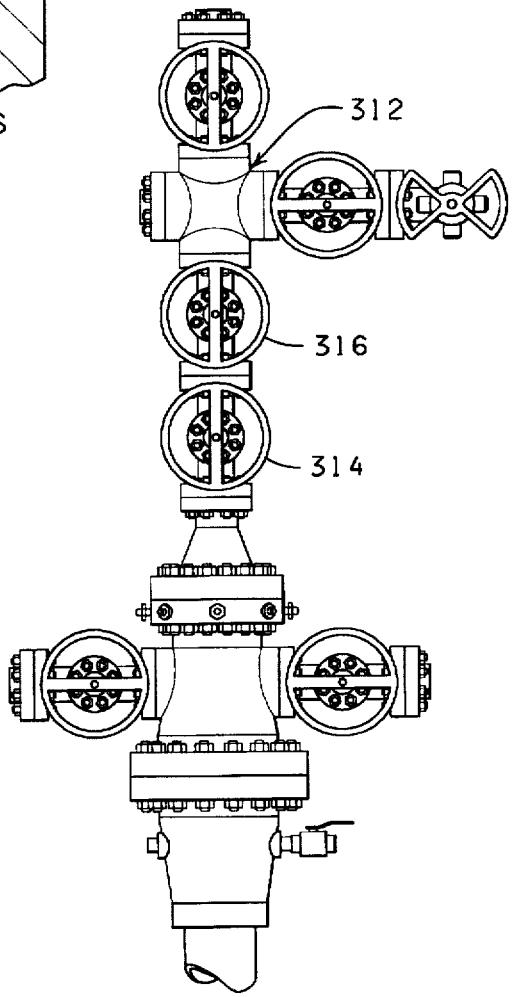
FIG. 13 is an elevational view of a typical wellhead configuration for use in the installation of the external coiled tubing hanger of the present invention.
Figure 14:
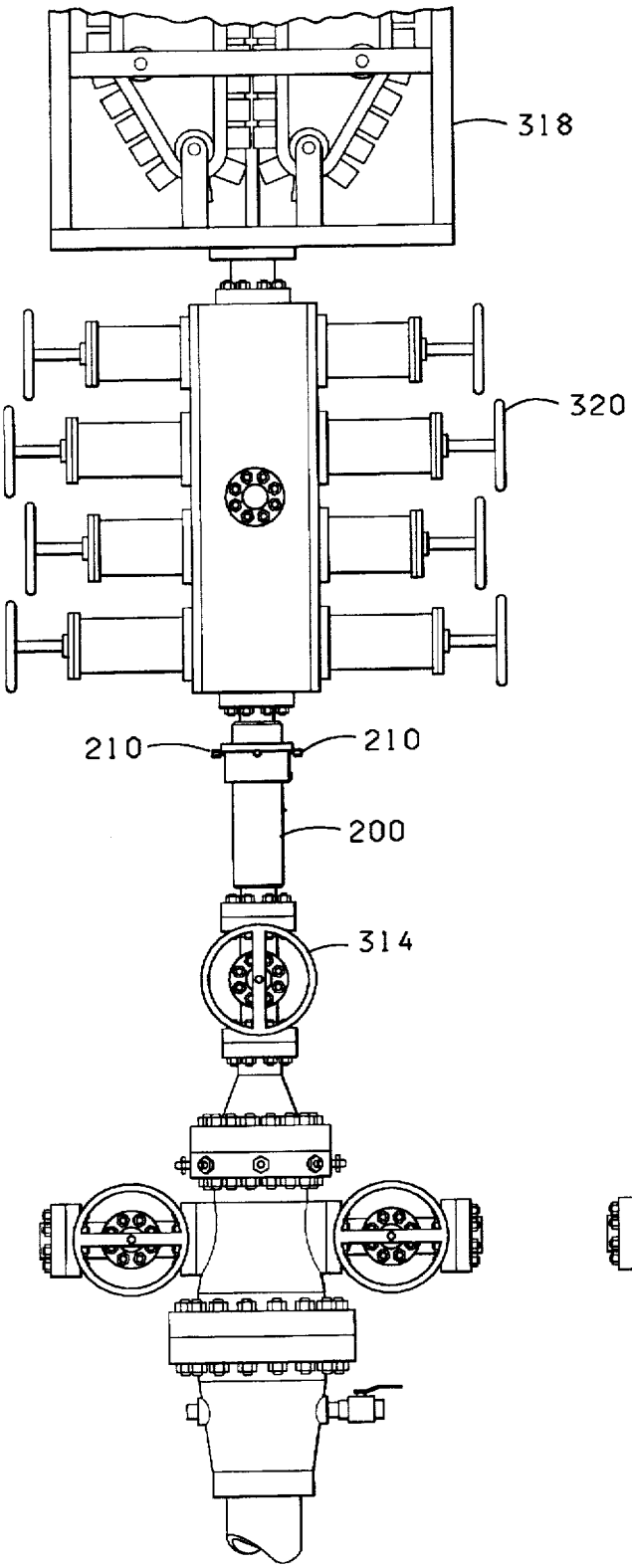
FIG. 14 is an elevational view showing the external coiled tubing hanger of FIG. 10, an injector unit, and a blowout preventer stack connected to the wellhead configuration.
Figure 15:
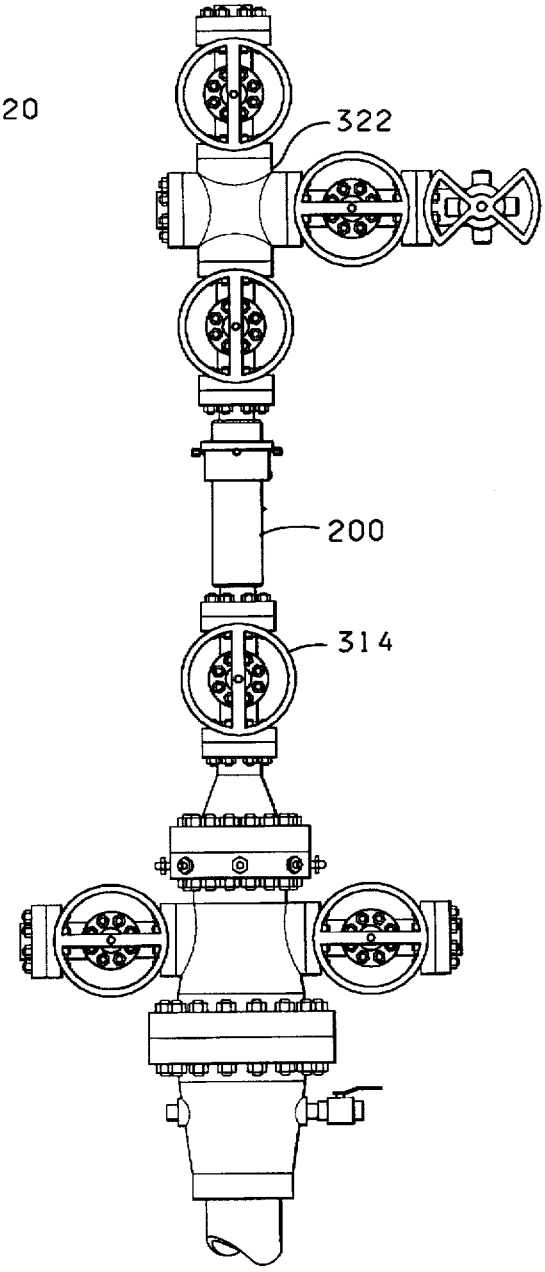
FIG. 15 is an elevational view showing the external coiled tubing hanger of FIG. 10 disposed in the wellhead configuration and with a christmas tree connected thereto.

FIGS. 13–15 illustrate the procedure for hanging coiled tubing from the coiled tubing hanger 200. FIG. 13 is an elevated view of a wellhead configuration 312 provided with a lower master valve 314 and an upper master valve 316. The well is shut in by closing the lower master valve 314 and the pressure bled off the upper portion of the wellhead configuration 312. The wellhead configuration 312 is then removed above the lower master valve 314. The coiled tubing hanger 200 is next installed on top of the lower master valve 314 and an injector unit 318 and blowout preventer stack 320 are installed on top of the coiled tubing hanger 200.

The coiled tubing is then run through the injector unit 318 and the blowout preventer stack 320. The pipe rams on the blowout preventer stack 320 are then closed about the coiled tubing and the lower master valve 314 is opened. The coiled tubing is then run to the desired depth.

To hang the coiled tubing from the coiled tubing hanger 200, the slip setting pins 210 are run inward in equal increments and in sequential order to move the slip segments 208 to the extended position where the slip segments 208 grippingly engage the coiled tubing. To securely set the slip segments 208, the operator applies a downward force of approximately 2,000 psi. Next, the injector unit 318 and the blowout preventer stack 320 are removed from the coiled tubing hanger 200 and the coiled tubing is cut. Finally, as illustrated in FIG. 15, a christmas tree 322 is installed on the coiled tubing hanger 200 and the plug provided in the end of the coiled tubing is pressured Out in a conventional manner.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. An apparatus for supporting a tubular member extending from a wellhead into a well bore, the apparatus comprising:

a hanger body adapted to be supported on the wellhead, the hanger body having a bore extending therethrough for receiving the tubular member and a slip bowl disposed therein having an internal support shoulder formed thereon, a straight portion extending substantially perpendicular from the support shoulder of the slip bowl a distance downward and a tapered portion extending from the straight portion to the lower end of the slip bowl;

a plurality of slip segments, each slip segment having a generally wedge-shaped configuration and characterized as having an upper end, a lower end, an outer side, and an inner side, the outer side having a protrusion extending therefrom and a tapered surface corresponding to the tapered portion of the slip bowl, the tapered surface of the slip segments extending from a distance below the protrusion to the lower end of the slip segment, the inner side of each of the slip segments having a curved configuration and having a plurality of serrations formed thereon adapted for gripping engagement with the tubular member, the slip segments movable between a retracted position wherein the tubular member is passable through the slip bowl and the protrusion of each slip segment is disposed on the internal support shoulder of the slip bowl so as to support the slip segments in the slip bowl and an extended position wherein slip segments are moved off of the internal shoulder of the slip bowl and into gripping engagement with the tubular member such that the slip segments are caused to slide downward along the tapered portion of the slip bowl so as to wedge the slip segments between the slip bowl and the tubular member to hold the tubular member when a downward force is applied to the tubular member;

slip segment retaining means for biasing the slip segments in the retracted position; and a plurality of slip setting pins extending radially through the hanger body in a spaced apart relation so as to be selectively engagable against the outer side of the slip segments such that the slip segments are moved to the extended position when the pins are urged toward the slip segments and such that the slip segments are biased in the retracted position when the pins are urged away from the slip segments.

2. The apparatus of claim 1 further comprising:

seal means supported in the hanger body for forming a substantially fluid tight seal between the tubular member and the wellhead while the tubular member is being inserted into the well bore.

3. The apparatus of claim 2 wherein the seal means comprises:

a lower spacer ring supported in the hanger body;

a primary seal member disposed in the lower spacer ring, the primary seal member forming a pressure activated seal when acted on by fluid pressure;

an intermediate spacer ring having an L-shaped section characterized as having a vertical leg and a horizontal leg, the intermediate spacer ring disposed on the lower spacer ring and the first seal member with the horizontal leg positioned across the lower spacer ring and the first seal member;

a secondary seal member disposed in the intermediate spacer ring and supported by the horizontal leg of the intermediate spacer ring such that the secondary seal member is separated from the primary seal member such that the secondary seal member is not pressure activated when the primary seal member is pressure activated; and an upper spacer ring supported by the intermediate spacer ring.

4. The apparatus of claim 2 wherein the hanger body is characterized has having an external side and an internal side, wherein the hanger body has a fluid passageway formed therethrough, and wherein the seal means comprises:

a lower spacer ring having an upper end, a lower end, and a protrusion positioned between the upper end and the lower end and extending inwardly therefrom;

a first seal member positioned in the lower spacer ring below the protrusion;

an upper spacer ring having an upper end with an inwardly extending lip, a lower end, and an outer annular recess which cooperates with the hanger body to define a void in fluid communication with the external side of the hanger body, the upper spacer ring positioned on the lower spacer ring so as to permit fluid flow between the lower end of the upper spacer ring and the upper end of the lower spacer ring;

at least two seal members disposed between the lip of the upper spacer ring and the protrusion of the lower spacer ring;

a pair of reciprocating rings positioned between the seal members disposed between the lip of the upper spacer ring and the protrusion of the lower spacer ring in the upper and lower spacer rings, the reciprocating rings configured and positioned adjacent the fluid passageway between the upper spacer ring and the lower spacer ring such that when pressurized hydraulic fluid is injected into the void via the fluid passageway through the hanger body, the reciprocating rings expand whereby one of reciprocating rings cooperates with the lip of the upper spacer ring to energize the seal member positioned between the lip and the reciprocating rings and the other reciprocating ring cooperates with the protrusion of the lower spacer ring to energize the seal member positioned between the protrusion and the reciprocating rings.

5. The apparatus of claim 1 wherein the tapered portion of the slip bowl is tapered at an angle of less than about eight degrees.

6. The apparatus of claim 2 wherein the hanger body is provided with an external annular groove extending about the hanger body, and wherein the seal means comprises:

an O-ring disposed in the annular groove to form a substantially fluid-tight seal between the external wall of the hanger body and the wellhead.

7. The apparatus of claim 1 wherein the serrations of each of the slip segments comprise a first set of serrations and a second set of serrations, the first set of serrations formed near the upper end of the slip segment and horizontally oriented so as to be adapted for bi-directional gripping engagement with the tubular member, the second set of serrations angled upwardly so as to be adapted for unidirectional gripping engagement with the tubular member.

8. The apparatus of claim 1 further comprising a ring member supported in the hanger body above the slip segments, the ring member having a beveled lip extending from the lower side thereof and configured to force the slip segments outwardly so as to disengage the slip segments from the tubular member and allow the slip segments to move to the retracted position when the slip segments are pulled upwardly into engagement with the ring member.

9. The apparatus of claim 1 wherein each of the slip segments has a spring retaining groove formed across the inner surface thereof, the spring retaining grooves cooperating to form an annular spring retaining groove, and wherein the slip segment retaining means comprises:

a slip retaining spring disposed in the annular spring retaining groove.

10. The apparatus of claim 1 wherein the hanger body is provided with an internal threaded bore for permitting a threaded connection with the hanger body from above the hanger body to facilitate removal of the hanger body from the wellhead.

11. The apparatus of claim 1 wherein each of the pins has a shaft portion and a head portion, the head portion having a first end and a second end, the head portions of the pins extending about the hanger body in an end-to-end relationship.

12. The apparatus of claim 11 wherein the wellhead includes a tubinghead having a tubinghead bowl and a plurality of lockdown pins extending radially from the tubinghead, and wherein the hanger body is adapted to be sealingly supported in the tubinghead bowl of the tubinghead with the lockdown pins of the tubinghead engagable against the heads of the slip setting pins to urge the slip setting pins inwardly.

13. The apparatus of claim 12 wherein the slip setting pins are biased outwardly when the lockdown pins are urged outwardly.

14. The apparatus of claim 1 wherein the hanger body is adapted to be connected to the wellhead.

15. An apparatus for supporting a tubular member extending from a wellhead into a well bore, the apparatus comprising:

a hanger body having an upper end, a lower end, an external surface, and an internal surface, the internal surface defining a bore extending vertically through the hanger body for receiving the tubular member, the hanger body being adapted to be supported on the wellhead;

lower seal means supported in the hanger body for forming a pressure activated fluid tight seal about the tubular member;

a slip bowl having an upper end, a lower end, an external surface, and an internal surface, the internal surface defining a bore extending vertically through the slip bowl and having an internal support shoulder formed thereon, the internal surface characterized as having a straight portion extending substantially perpendicular from the support shoulder of the slip bowl a distance downward and a tapered portion extending from the straight portion to the lower end of the slip bowl, the slip bowl supported in the hanger body;

a plurality of slip segments, each slip segment having a generally wedge-shaped configuration and characterized as having an upper end, a lower end, an outer side, and an inner side, the outer side having a protrusion extending therefrom and a tapered surface corresponding to the tapered portion of the internal surface of the slip bowl, the tapered surface of the slip segments extending from a distance below the protrusion to the lower end of the slip segment, the inner side having a curved configuration and having a first set of serrations formed near the upper end of the slip segment and horizontally oriented so as to be adapted for bi-directional gripping engagement with the tubular member and a second set of serrations angled upwardly so as to be adapted for uni-directional gripping engagement with the tubular member, the slip segments movable between a retracted position wherein the tubular member is passable through the slip bowl and the protrusion of each slip segment is positioned on the internal support shoulder of the slip bowl so as to support the slip segments in the slip bowl and an extended position wherein the first and second set of serrations of the slip segments grippingly engage the tubular member so as to cause the slip segments to slide downward along the tapered portion of the slip bowl and wedge between the slip bowl and the tubular member to hold the tubular member when a downward force is applied to the tubular member;

slip segment retaining means for biasing the slip segments in the retracted position;

upper seal means supported in the hanger body above the slip segments for forming a pressure activated fluid tight seal about the tubular member; and a plurality of slip setting pins extending radially through the hanger body and slip bowl in a spaced apart relation so as to be selectively engagable against the outer side of the slip segments such that the slip segments are moved to the extended position when the pins are urged inwardly toward the slip segments and such that the slip segments are biased in the retracted position when the pins are urged outwardly away from the slip segments.

16. The apparatus of claim 15 wherein the lower seal means comprises:

a lower spacer ring supported in the hanger body;

a primary seal member disposed in the lower spacer ring, the primary seal member forming a pressure activated seal when acted on by fluid pressure;

an intermediate spacer ring having an L-shaped section characterized as having a vertical leg and a horizontal leg, the intermediate spacer ring disposed on the lower spacer ring and the first seal member with the horizontal leg positioned across the lower spacer ring and the first seal member;

a secondary seal member disposed in the intermediate spacer ring and supported by the horizontal leg of the intermediate spacer ring such that the secondary seal member is separated from the primary seal member such that the secondary seal member is not pressure activated when the primary seal member is pressure activated; and an upper spacer ring supported by the intermediate spacer ring.

17. The apparatus of claim 15 wherein the hanger body has a fluid passageway formed therethrough from the external side to the internal side thereof, and wherein the lower seal means comprises:

a lower spacer ring having an upper end, a lower end, and a protrusion positioned between the upper end and the lower end and extending inwardly therefrom;

a first seal member positioned in the lower spacer ring below the protrusion;

an upper spacer ring having an upper end with an inwardly extending lip, a lower end, and an outer annular recess which cooperates with the hanger body to define a void in fluid communication with the external side of the hanger body, the upper spacer ring positioned on the lower spacer ring so as to permit fluid flow between the lower end of the upper spacer ring and the upper end of the lower spacer ring;

at least two seal members disposed between the lip of the upper spacer ring and the protrusion of the lower spacer ring;

a pair of reciprocating rings positioned between the seal members disposed between the lip of the upper spacer ring and the protrusion of the lower spacer ring in the upper and lower spacer rings, the reciprocating rings configured and positioned adjacent the fluid passageway between the upper spacer ring and the lower spacer ring such that when pressurized hydraulic fluid is injected into the void via the fluid passageway through the hanger body, the reciprocating rings expand whereby one of reciprocating rings cooperates with the lip of the upper spacer ring to energize the seal member positioned between the lip and the reciprocating rings and the other reciprocating ring cooperates with the protrusion of the lower spacer ring to energize the seal member positioned between the protrusion and the reciprocating rings.

18. The apparatus of claim 15 wherein the tapered portion of the slip bowl is tapered at an angle of less than about eight degrees.

19. The apparatus of claim 15 further comprising a ring member supported in the hanger body above the slip segments, the ring member having a beveled lip extending from the lower side thereof and configured to force the slip segments outwardly so as to disengage the slip segments from the tubular member and allow the slip segments to move to the retracted position when the slip segments are pulled upwardly into engagement with the ring member.

20. The apparatus of claim 15 wherein each of the slip segments has a spring retaining groove formed across the inner surface thereof, the spring retaining grooves cooperating to form an annular spring retaining groove, and wherein the slip segment retaining means comprises:

a slip retaining spring disposed in the annular spring retaining groove.

21. The apparatus of claim 15 wherein the hanger body is provided with an internal threaded bore for permitting a threaded connection with the hanger body from above the hanger body to facilitate removal of the hanger body from the wellhead.

22. The apparatus of claim 15 wherein each of the slip setting pins has a shaft portion and a head portion, the head portion having a first end and a second end, the head portions of the pins extending about the hanger body in an end-to-end relationship.

23. The apparatus of claim 22 wherein the wellhead includes a tubinghead having a tubinghead bowl and a plurality of lockdown pins extending radially from the tubinghead, and wherein the hanger body is adapted to be sealingly supported in the tubinghead bowl of the tubinghead with the lockdown pins of the tubinghead engagable against the heads of the slip setting pins to urge the slip setting pins inwardly.

24. The apparatus of claim 23 wherein the hanger body is provided with an external annular groove extending about the hanger body, and wherein the apparatus further comprises:

an O-ring disposed in the annular groove to form a substantially fluid-tight seal between the external wall of the hanger body and the wellhead.

25. The apparatus of claim 23 wherein the slip setting pins are biased outwardly when the lockdown pins are urged outwardly.

26. The apparatus of claim 15 wherein the hanger body is adapted to be connected to the wellhead.

27. A method for suspending a string of coiled tubing into a well bore from a wellhead, the method comprising the steps of:

detachably connecting a tubing hanger to the free end of the tubing, the tubing hanger comprising:

a hanger body adapted to be supported in the wellhead, the hanger body having a bore extending therethrough for receiving the tubing and a slip bowl disposed therein having an internal support shoulder formed thereon and a tapered portion; and a plurality of slip segments, each slip segment having a generally wedge-shaped configuration and characterized as having an upper end, a lower end, an outer side, and an inner side, the outer side having a protrusion extending therefrom and a tapered surface corresponding to the tapered portion of the slip bowl, the inner side of each of the slip segments having a curved configuration and having a plurality of serrations formed thereon adapted for gripping engagement with the tubular member;

running the tubing and the tubing hanger into the wellhead until the tubing hanger is set in the wellhead;

placing the slip segments in a retracted position wherein the tubing is passable through the slip bowl and the protrusion of each slip segment is disposed on the internal support shoulder of the slip bowl so as to support the slip segments in the slip bowl;

detaching the tubing from the tubing hanger so that the tubing is free to pass through the tubing hanger;

passing the tubing into the well bore to a desired depth;

moving each of the slip segments to an extended position wherein each of the slip segments are moved off of the internal shoulder of the slip bowl and into gripping engagement with the tubing; and applying a downward force on the tubing such that the slip segments are caused to slide downward along the tapered portion of the slip bowl so as to wedge the slip segments between the slip bowl and the tubing to suspend the tubing from the wellhead.

28. The method of claim 27 wherein the step of connecting the tubing hanger to the tubing comprises the step of connecting the tubing hanger to the tubing with a plurality of shear screws and wherein the step of detaching the tubing from the tubing hanger comprises the step of applying a downward force to the tubing sufficient to shear the shear screws.

29. The method of claim 27 further comprising the steps of:

forming a fluid tight seal between the tubing and the hanger body while the tubing is being run into the well bore.

30. The method of claim 27 further comprising ejecting a pressurized fluid from the end of the tubing via a nozzle connected to the end of the tubing as the tubing hanger is being lowered into the wellhead to effect the removal of debris from the wellhead.

31. The method of claim 27 further comprising the step of:

equalizing the pressure in the wellhead above and below the tubing hanger as the tubing hanger is being lowered into the wellhead.

* * * * *

UNITED STATES PATENT AND TRADEMARK OFFICE

CERTIFICATE OF CORRECTION

PATENT NO. : 5,727,631

DATED : March 17, 1998

INVENTOR(S) : Baker et al.

It is certified that error appears in the above-identified patent and that said Letters Patent is hereby corrected as shown below:

Column 1, line 43, delete "have" and substitute therefor --has--.

Column 4, line 27, delete "slip setting pins 20" and substitute therefor --slip segment setting pins 20--.

Column 14, line 2, delete "has" and substitute therefor --as--.

Column 14, line 31, before "reciprocating" insert --the--.

Column 17, line 7, before "reciprocating" insert --the--.

Signed and Sealed this

Twentieth Day of October, 1998

*Attest:*

*Attesting Officer*

BRUCE LEHMAN

*Commissioner of Patents and Trademarks*